US009920972B2

(12) United States Patent
Azzopardi

(10) Patent No.: US 9,920,972 B2
(45) Date of Patent: Mar. 20, 2018

(54) DUAL TRAILER COOLING UNIT

(71) Applicant: Azzopardi Technology Group, LLC, Spreckels, CA (US)

(72) Inventor: Michael J. Azzopardi, Salinas, CA (US)

(73) Assignee: Azzopardi Technology Group, LLC, Spreckels, CA (US)

( * ) Notice: Subject to any disclaimer, the term of this patent is extended or adjusted under 35 U.S.C. 154(b) by 60 days.

(21) Appl. No.: 14/880,735

(22) Filed: Oct. 12, 2015

(65) Prior Publication Data

US 2017/0102178 A1 Apr. 13, 2017

(51) Int. Cl.

| | |
|---|---|
| ***F25B 15/00*** | (2006.01) |
| ***F25D 13/06*** | (2006.01) |
| ***F25D 15/00*** | (2006.01) |
| *F25D 11/00* | (2006.01) |
| *F25D 17/06* | (2006.01) |

(52) U.S. Cl.

CPC ..... *F25D 13/067* (2013.01); *F25D 15/00* (2013.01); *F25D 11/003* (2013.01); *F25D 17/06* (2013.01)

(58) Field of Classification Search

CPC ..... F25D 13/067; F25D 19/003; F25D 13/02; F25D 13/06; F25D 23/087; F25D 17/06; F25D 17/045; F25D 2500/02; F25D 2317/0681; F25D 2317/0682; F25D 2317/0655; F25D 25/02; F25D 25/04; F25D 21/065; F25D 23/02; F25D 21/04; F25D 3/11; F25D 3/31; A23L 3/364; A23L 3/363; A23L 3/3418; F26B 3/08; F25B 5/02; F25B 21/02; F25B 2500/06; F25B 2400/21

USPC ..... 62/63, 380

See application file for complete search history.

(56) References Cited

U.S. PATENT DOCUMENTS

| | | | | |
|---|---|---|---|---|
| 2,126,801 | A * | 8/1938 | Norbom | B65G 63/025 414/345 |
| 2,337,600 | A * | 12/1943 | Harris | B61D 27/0027 426/419 |
| 2,699,048 | A | 1/1955 | Brunsing | |
| 2,722,112 | A | 11/1955 | Anderson | |
| 2,770,111 | A | 11/1956 | Rear | |
| 2,786,342 | A | 3/1957 | Goetz | |

(Continued)

OTHER PUBLICATIONS

Timothy J. Rennie, "Vacuum cooling for the fruit and vegetable industry," Stewart Postharvest Review 2006, 1:7, published online Feb. 1, 2006.

(Continued)

*Primary Examiner* — Mohammad M Ali

(74) *Attorney, Agent, or Firm* — Vierra Magen Marcus LLP

(57) ABSTRACT

A portable cooling unit is disclosed for cooling perishable items such as strawberries at a worksite such as a field where the strawberries are harvested. The cooling unit includes a conveyor trailer for receiving pallets of perishable items and conveying the pallets through a number of cooling chambers within the conveyor trailer. The cooling unit further includes a refrigeration trailer for supplying independent cold air flow paths to the different cooling chambers of the conveyor trailer. The conveyor and refrigeration trailers may operate as a self-sustained cooling unit, without any external connections to power or working fluid.

17 Claims, 14 Drawing Sheets

(56) References Cited

U.S. PATENT DOCUMENTS

| | | | | |
|---|---|---|---|---|
| 2,832,690 | A | 4/1958 | Louis et al. | |
| 2,886,858 | A | 5/1959 | Goetz | |
| 2,963,876 | A | 12/1960 | Hibbs, Jr. | |
| 2,996,898 | A | 8/1961 | Hosken et al. | |
| 3,009,334 | A | 11/1961 | Baker et al. | |
| 3,110,163 | A | 11/1963 | Webb | |
| 3,197,973 | A | 8/1965 | Rannenberg et al. | |
| 3,339,967 | A | 9/1967 | Harris | |
| 3,604,217 | A | 9/1971 | Spear | |
| 3,844,132 | A | 10/1974 | Miller et al. | |
| 4,204,408 | A | 5/1980 | Dawson | |
| 4,407,140 | A | 10/1983 | Kobayashi | |
| 4,576,014 | A | 3/1986 | Miller et al. | |
| 4,598,555 | A | 7/1986 | Windecker | |
| 4,615,178 | A | 10/1986 | Badenhop | |
| 4,888,960 | A * | 12/1989 | Lara | A23B 7/0408 62/298 |
| 5,287,705 | A | 2/1994 | Roehrich et al. | |
| 5,375,431 | A | 12/1994 | Later et al. | |
| 5,438,840 | A | 8/1995 | Barber, III et al. | |
| 6,202,434 | B1 | 3/2001 | Hearne, Jr. | |
| 6,227,002 | B1 * | 5/2001 | Bianco | A23L 3/364 62/239 |
| 6,746,323 | B1 * | 6/2004 | Digby, Jr. | B60H 1/00378 454/119 |
| RE39,924 | E | 11/2007 | Dube | |
| 7,832,218 | B2 | 11/2010 | Hawkins | |
| 2007/0017233 | A1 | 1/2007 | Hawkins | |
| 2009/0120622 | A1 | 5/2009 | Koch | |
| 2009/0124461 | A1 | 5/2009 | Pinto | |
| 2010/0071384 | A1 | 3/2010 | Lu et al. | |
| 2011/0138820 | A1 | 6/2011 | Weeth et al. | |
| 2013/0104585 | A1 | 5/2013 | Weeth et al. | |

OTHER PUBLICATIONS

Non-Final Rejection dated Jul. 9, 2013 in U.S. Appl. No. 13/282,250.

Final Rejection dated May 6, 2014 in U.S. Appl. No. 13/282,280.

Non-Final Rejection dated Nov. 13, 2014 in U.S. Appl. No. 13/282,250.

Final Rejection dated Aug. 26, 2015 in U.S. Appl. No. 13/282,250.

Amendment dated Jan. 9, 2014 in U.S. Appl. No. 13/282,250.

Amendment dated Oct. 6, 2014 in U.S. Appl. No. 13/282,250.

Amendment dated May 13, 2015 in U.S. Appl. No. 13/282,250.

ColdPICK International, "ColdPICK M1", ColdPICK Mobmile Pre Coolers, Retrieved from the Internet on Oct. 5, 2015.

ColdPICK International, "ColdPICK M6", ColdPICK Mobmile Pre Coolers, Retrieved from the Internet on Oct. 5, 2015.

* cited by examiner

DUAL TRAILER COOLING UNIT

BACKGROUND

Fruits and vegetables are living organisms that continue essential chemical and physiological activities after harvest. These activities can include physiological breakdown, physical injury to tissue, invasion by microorganisms, and moisture loss. Additionally, some fruits and vegetables can suffer damage while being transported hot from the field. Thus, the time between harvest and cooling to remove field heat and slow plant respiration, otherwise known as the "cut-to-cool" interval, is critical for ensuring the quality and safety of the product.

The term "cold chain" refers to the uninterrupted temperature management of perishable product in order to maintain quality and safety from the point of post-harvest cooling through the distribution chain to the final consumer. The cold chain ensures that perishable product are safe and of high quality at the point of consumption. Failing to keep product at the correct temperatures can result in a variety of negative attributes including, among others, textural degradation, discoloring, bruising, and microbial growth.

Typically, fruits and vegetables may be harvested into trucks which carry the produce to fixed-base cooling facilities, where the produce is cooled and the cold chain begins. The produce is then transported from the cooling facilities to their final destination, often in refrigerated semitrailers called reefers. Starting the cold chain at the cooling facility has several drawbacks. For example, during transport from the field to the cooling facility in open vehicles, the produce is generally exposed to wind, sun and heat, which can result in moisture loss, physiological breakdown and textural degradation. A further drawback is the need to have produce grown proximately to cooling facilities to minimize the time between harvest and start of the cold chain.

Pressure cooling units at a cooling facility are generally referred to as fixed-base units, in that it is a difficult and time consuming process to break down and transport these cooling units. First, the fixed-base cooling units tend to be large, and do not break down into small sub-units which may be easily transported. Second, ammonia is a preferred circulating refrigerant within the evaporator/condenser assembly. Ammonia is a highly controlled substance due to its potential dangers if spilled, and Environmental Protection Agency's Risk Management Program (RMP) promulgates several regulations for the use and transport of ammonia. For example, operating and safety permits are required when working with 500 lbs. of ammonia or more (fixed-base cooling units use at least this amount). Moreover, when transporting this quantity of ammonia, the ammonia must first be pumped down and evacuated from the pipes and condenser circulation system, and a specialized and authorized technician must be present to oversee the break down process. All of this makes it difficult, time-intensive and costly to break down fixed-based cooling units.

DETAILED DESCRIPTION

Embodiments of the present disclosure will now be described with reference to FIGS. 1-13B which in general relate to a cooling unit comprised of a pair of trailers for cooling produce or other perishable foodstuffs or items. A first trailer may be a conveyor trailer for receiving pallets of perishable items and conveying the pallets through a number of cooling chambers within the conveyor trailer. A second trailer may be a refrigeration trailer for supplying independent cold air flows to the different cooling chambers of the conveyor trailer. The conveyor and refrigeration trailers may be easily assembled alongside each other at a worksite such as a field where produce is harvested to allow initiation of the cold chain at the field level. The conveyor and refrigeration trailers may operate as a self-sustained cooling unit, without any external connections to power or working fluid.

It is understood that the present invention may be embodied in many different forms and should not be construed as being limited to the embodiments set forth herein. Rather, these embodiments are provided so that this disclosure will be thorough and complete and will fully convey the invention to those skilled in the art. Indeed, the invention is intended to cover alternatives, modifications and equivalents of these embodiments, which are included within the scope and spirit of the invention as defined by the appended claims. Furthermore, in the following detailed description of the present invention, numerous specific details are set forth in order to provide a thorough understanding of the present invention. However, it will be clear to those of ordinary skill in the art that the present invention may be practiced without such specific details.

The terms "top" and "bottom," "upper" and "lower," "vertical" and "horizontal" and "front" and "rear" as may be used herein are by way of example and illustrative purposes only, and are not meant to limit the description of the invention inasmuch as the referenced item can be exchanged in position and orientation. Also, as used herein, the terms "substantially" and/or "about" mean that the specified dimension or parameter may be varied within an acceptable manufacturing tolerance for a given application. In one embodiment, the acceptable manufacturing tolerance is ±0.25%.

Figure 1:
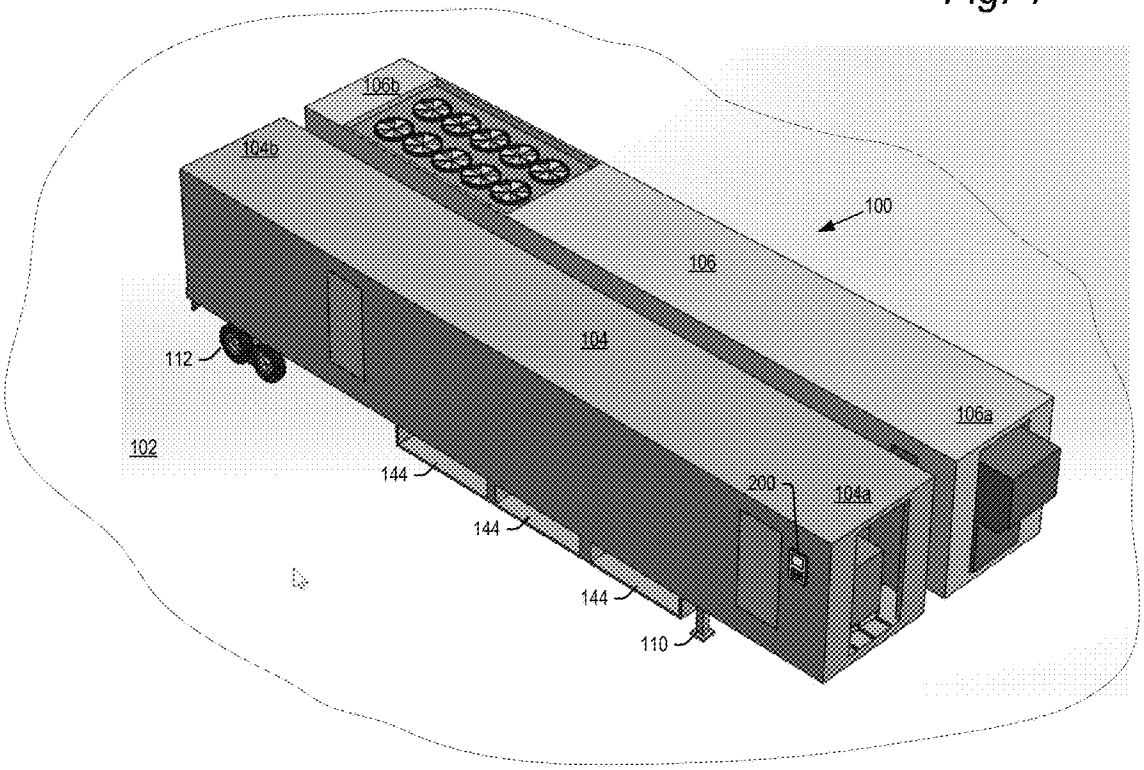
FIG. 1 is a top view of a portable cooling unit including dual trailers in operation at a worksite such as a field where produce is harvested.

FIG. 1 shows a portable cooling unit 100 for cooling perishable items such as produce to begin the cold chain. The cooling unit 100 may employ a pressure cooling process effective for cooling fruits such as strawberries, but it is understood that the cooling unit 100 may be employed to cool any of a wide variety of fruits, vegetables, meats, other foodstuffs and perishable items in general. The cooling unit 100 is shown in FIG. 1 deployed at a worksite 102, which in embodiments may be a field where produce is harvested. In such embodiments, the present technology allows the cold chain to start at the field-level right after the produce is harvested. This is in contrast to conventional systems where the cold chain does not start until product is transported from the field to a fixed-base cooling facility where it is then processed. In other embodiments, it is understood that the worksite 102 may be any location where product is cooled, including for example a traditional fixed-base cooling facility.

In examples, the cooling unit 100 may be comprised of a first trailer, referred to herein as a conveyor trailer 104, and a second trailer, referred to herein as a refrigeration trailer 106. Conveyor trailer 104 may include a front 104*a* and a rear 104*b*. Similarly, refrigeration trailer 106 may include a front 106*a* and a rear 106*b*. The front of each of the trailers 104, 106 may include couplings (not shown) for connecting the trailers to trailer cabs (not shown) so that the trailers 104, 106 may be driven to the worksite 102 and positioned.

Upon arrival at the worksite 102, the trailers 104 and 106 may be aligned side-by-side as shown in FIG. 1 and decoupled from their cabs. Stabilizers 110 (one of which is shown in FIG. 1) may be lowered to support the trailers 104 and 106 in position with respect to each other. A pair of stabilizers 110 may be provided at the front 104*a* on opposite sides of the conveyer trailer. The rear 104*b* of the conveyor trailer 104 may be supported on the rear axle wheels 112, or alternatively on a second pair of stabilizers (not shown). The refrigeration trailer 106 may have a similar configuration of stabilizers 110. Additional pairs of stabilizers may be provided along the length of trailers 104 and/or 106. Each stabilizer 110 may have telescopic sections for adjusting its height to generally align the refrigeration trailer 106 in a proper position to the conveyor trailer 104 (front to back and with respect to height) as explained below.

Figure 2:
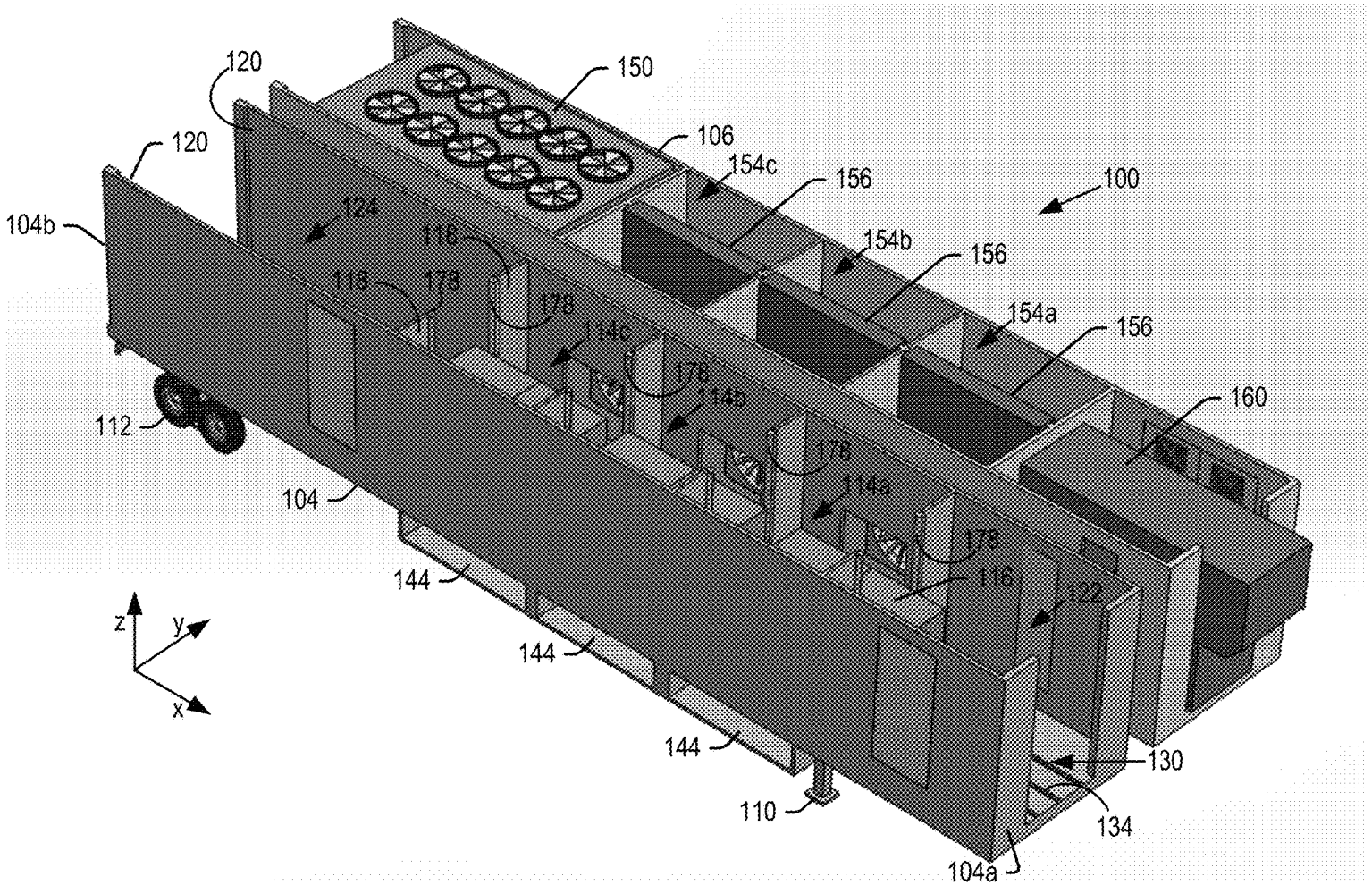
FIG. 2 is a perspective view of a portable cooling unit including dual trailers with their ceilings removed for clarity according to embodiments of the present disclosure.
Figure 3:
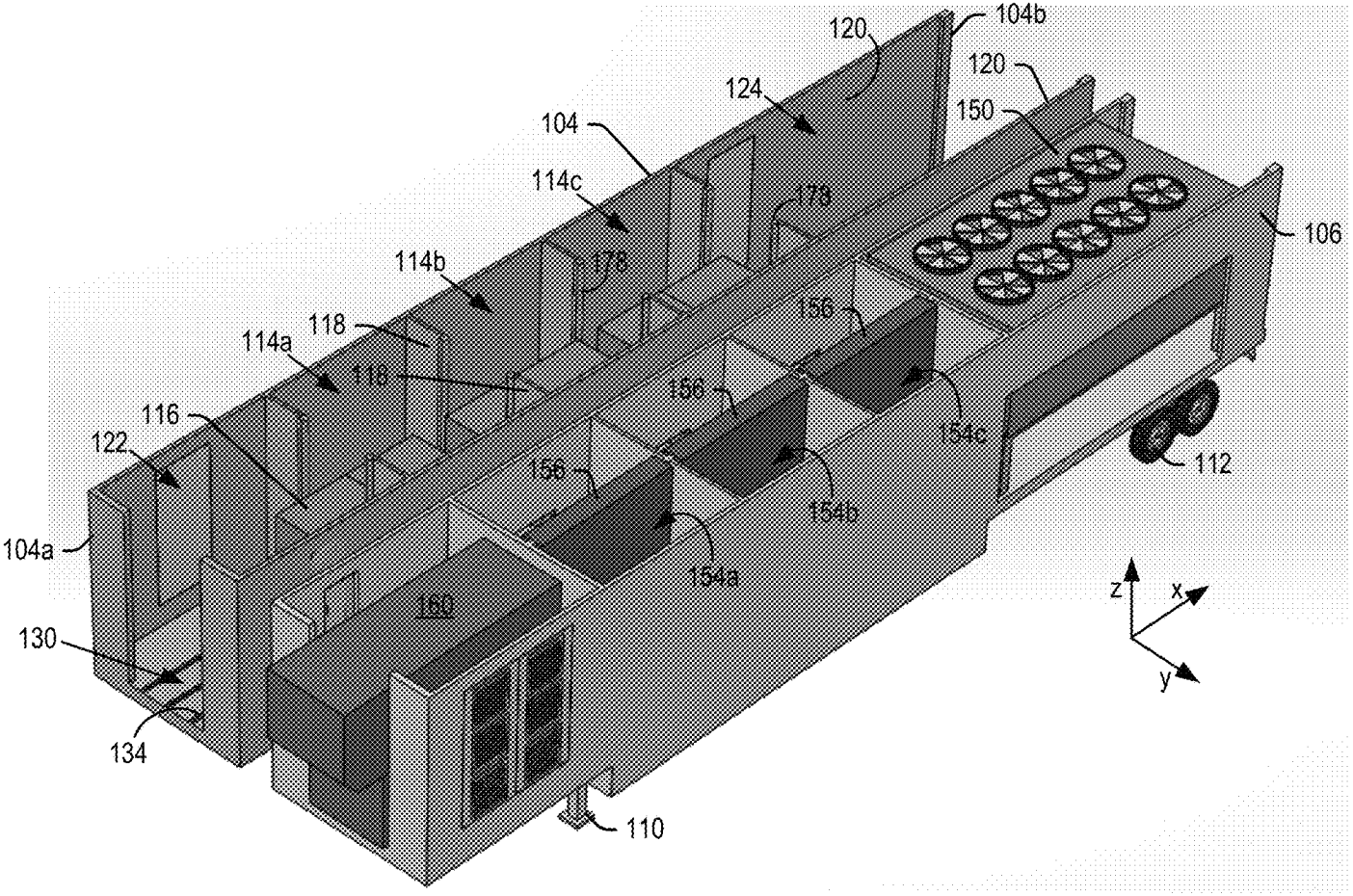
FIG. 3 is an alternative perspective view of a portable cooling unit including dual trailers with their ceilings removed for clarity according to embodiments of the present disclosure.

FIGS. 2 and 3 show different perspective views of the conveyor and refrigeration trailers 104, 106, with a top portion of the trailers 104, 106 removed for illustration of the interiors of the trailers 104 and 106. The interior of the conveyor trailer 104 includes a number of discrete, sealable cooling chambers 114, within each of which pallets of perishable items 116 may be cooled independently of pallets of perishable items in other cooling chambers. The respective chambers 114 may be defined by dividers 118 extending from opposed sidewalls 120 of the conveyor trailer 104.

The embodiment shown in FIGS. 2 and 3 includes three cooling chambers 114 (114*a*, 114*b* and 114*c*), each sized to cool perishable items stacked vertically in a column on a pair of pallets. The pair of pallets may be positioned within a cooling chamber end-to-end with each other along the conveyance direction (arbitrarily defined as the x-direction in the drawings). While three cooling chambers have been determined to be optimal for field level cooling of perishable items such as strawberries, it is understood that the conveyor trailer 104 may include a single cooling chamber, two cooling chambers or more than three cooling chambers 114 in further embodiments.

Additionally, it is understood that each cooling chamber 114 may be sized to cool a single stacked column of perishable items, or more than two end-to-end columns of perishable items. Each cooling chamber 114 may have a height in the z-direction tall enough to fit a vertical column of perishable items 116. Each cooling chamber 114 may have a seal which lowers into contact with an upper surface of the perishable items 116 as explained below. The seal may lower more or less to accommodate perishable items 116 of different vertical heights.

A first staging area 122 may be provided at the front 104*a* of the conveyor trailer 104 for loading pallets of perishable items 116 into the conveyor trailer 104. A second staging area 124 may be provided at the rear 104*b* of the conveyor trailer 104 for offloading pallets of perishable items 116 once cooled within the conveyor trailer 104.

Each of the first and second staging areas 122, 124 and cooling chambers 114 may include its own conveyor system 130 (FIGS. 2, 3 and 5) for conveying pallets from the first staging area 122 to the cooling chambers, and from the cooling chambers to the second staging area 124. The conveyor systems 130 of the first and second staging areas 122, 124 and cooling chambers 114 may operate independently of each other so that pallets within the first and second staging areas 122, 124 and the respective cooling chambers 114 may be advanced at different times.

Thus, for example, the conveyor system 130 in cooling chamber 114*c* may advance a pair of pallets from cooling chamber 114*c* to the second staging area 124. Thereafter, the conveyor system 130 in cooling chamber 114*b* may advance a pair of pallets from cooling chamber 114*b* to the cooling chamber 114*c*. Thereafter, the conveyor system 130 in cooling chamber 114*a* may advance a pair of pallets from cooling chamber 114*a* to the cooling chamber 114*b*. Thereafter, the conveyor system 130 in first staging area 122 may advance a pair of pallets from the first staging area to the cooling chamber 114*b*. This independent control of pallets conveyance provides a high degree of flexibility in the cooling of perishable items, for example allowing pallets to remain in a first cooling chamber 114 for a longer or shorter length of time than in a second cooling chamber 114. The conveyor systems 130 in the staging areas 122, 124 and in cooling chambers 114 may advance the pallets in unison in further embodiments.

Figure 4:
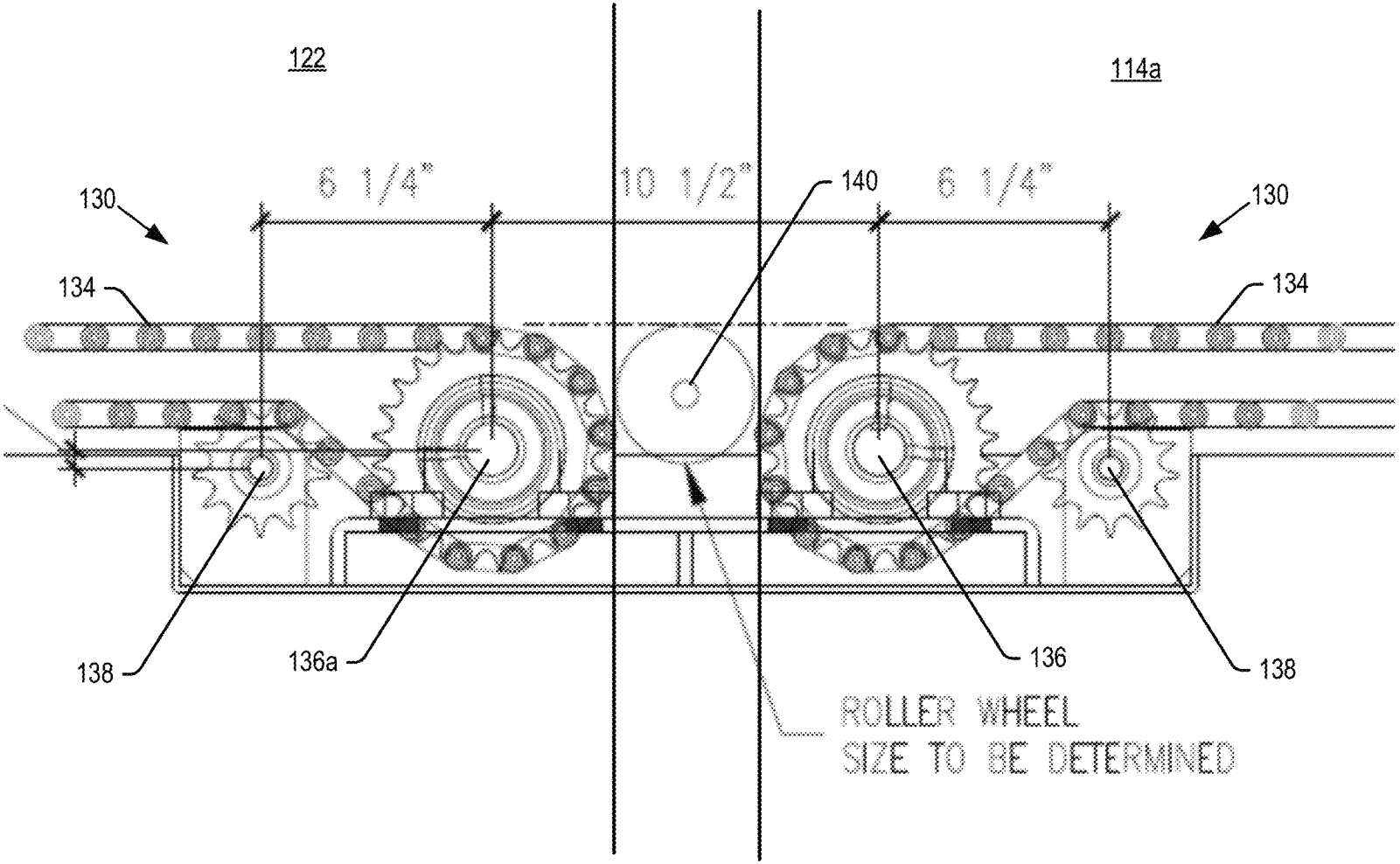
FIG. 4 is a side view of portions of a chain conveyor system for conveying pallets of perishable items through the conveyor trailer.

FIG. 4 illustrates portions of two different conveyor systems 130 adjacent to each other, such as for example between the first staging area 122 and the first cooling chamber 114*a*. Each conveyor system 130 may be comprised of a chain 134 wrapped around a pair of chain rings 136 (the chain rings 136 of two different conveyor systems 130 being shown in FIG. 4). One of the chain rings 136 may be a driven chain ring (e.g., 136*a*) affixed to the output shaft of a motor (not shown). A tensioning wheel 138 may also be provided to deflect the chain 134, and maintain the proper tension within the chain 134. The pallets may be supported on an upper surface of the chain 134. Rotation of the driven chain ring 136*a* by the motor rotates the chain 134 to advance the pallets within and between the staging areas and cooling chambers. The motor may be controlled by a control system 200 as described below. A roller wheel 140 may be provided between chains 134 of adjacent conveyor systems 130 to allow a smooth transition of pallets from one conveyor system 130 to another.

FIGS. 2 and 3 show a beginning portion of the conveyor system 130 the first staging area 122. As seen, the conveyor system includes the chains 134 aligned in parallel with each other on which the pallets may be supported. Each of the chains 134 seen in FIGS. 2 and 3 may have chain rings 136 and tensioning wheels 138 as described above. The driven chain rings 136*a* of the respective chains in a given conveyor system 130 may be mounted on a common driveshaft from the conveyor system motor so as to rotate in unison and advance the respective chains at the same rate. The conveyor systems 130 in the cooling chambers 114 and second staging area 124 may similarly each include three chains 134 in their respective conveyor systems 130. It is understood that there may be more or less than three chains 134 in their respective conveyor systems. Moreover, it is understood that other known conveyor systems may be used instead of or in addition to the conveyor systems 130 described above.

Figure 5:
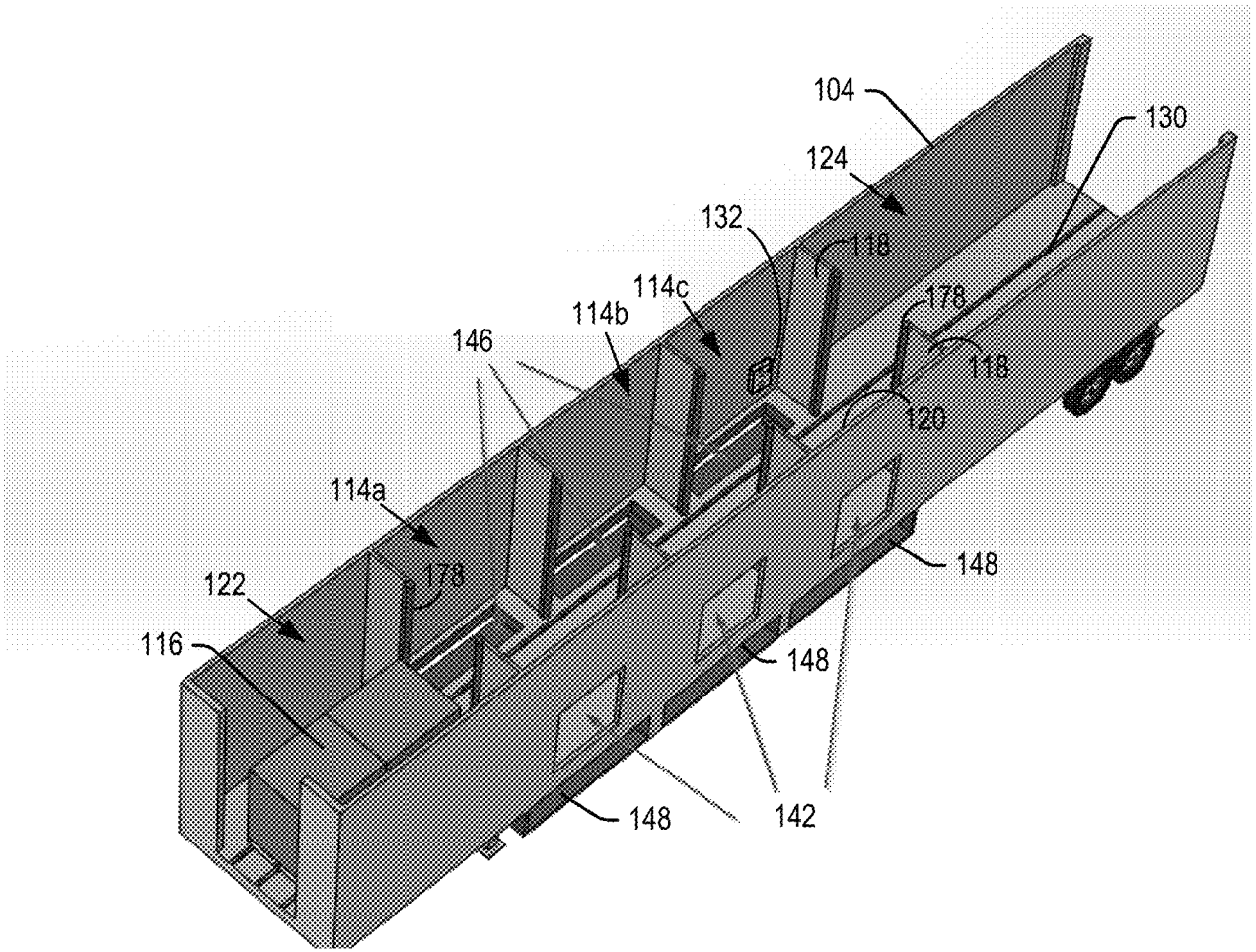
FIG. 5 is a perspective view of the conveyor trailer with the ceiling removed for clarity according to embodiments of the present disclosure.
Figure 6:
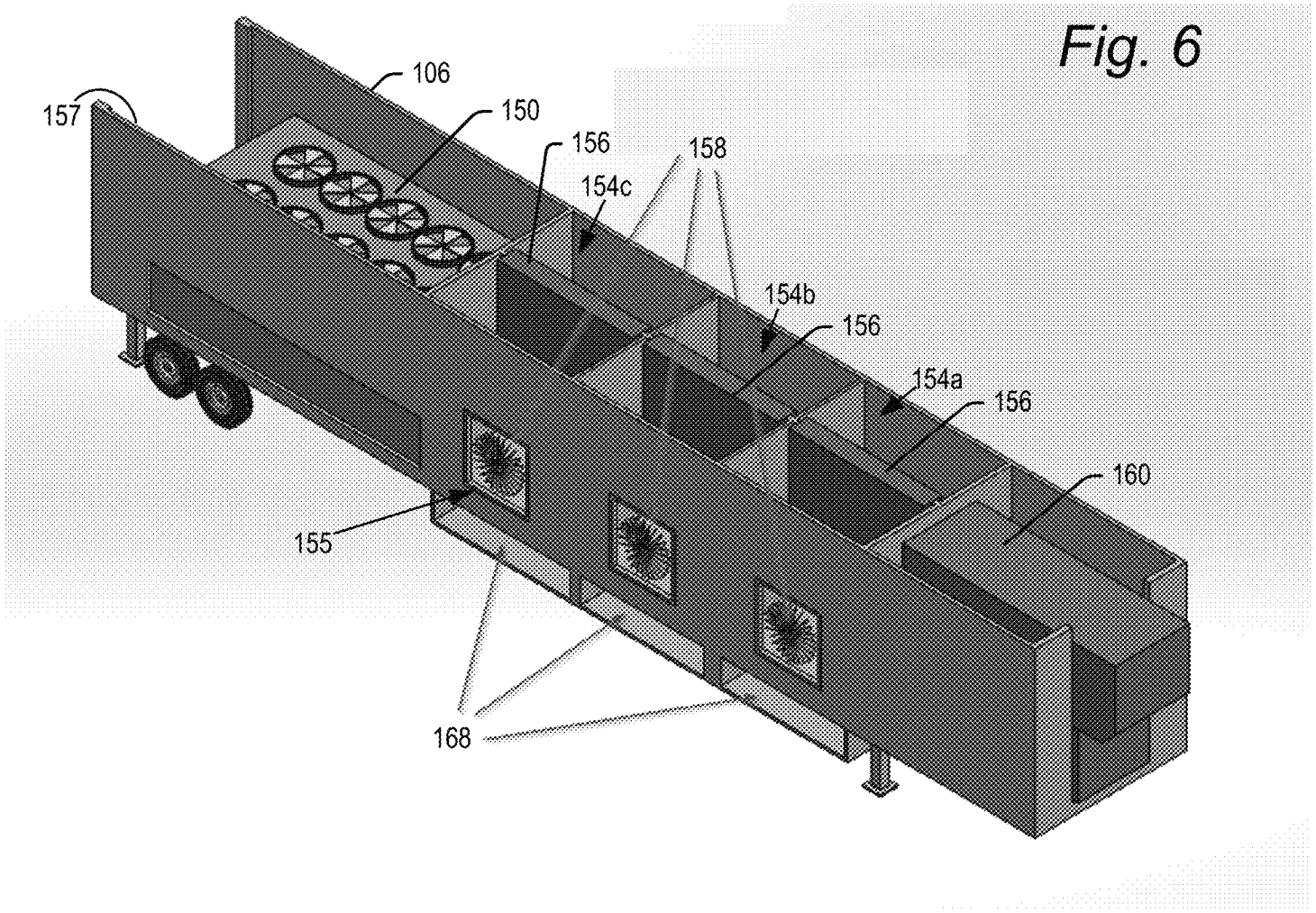
FIG. 6 is a perspective view of the refrigeration trailer with the ceiling removed for clarity according to embodiments of the present disclosure.
Figure 7:
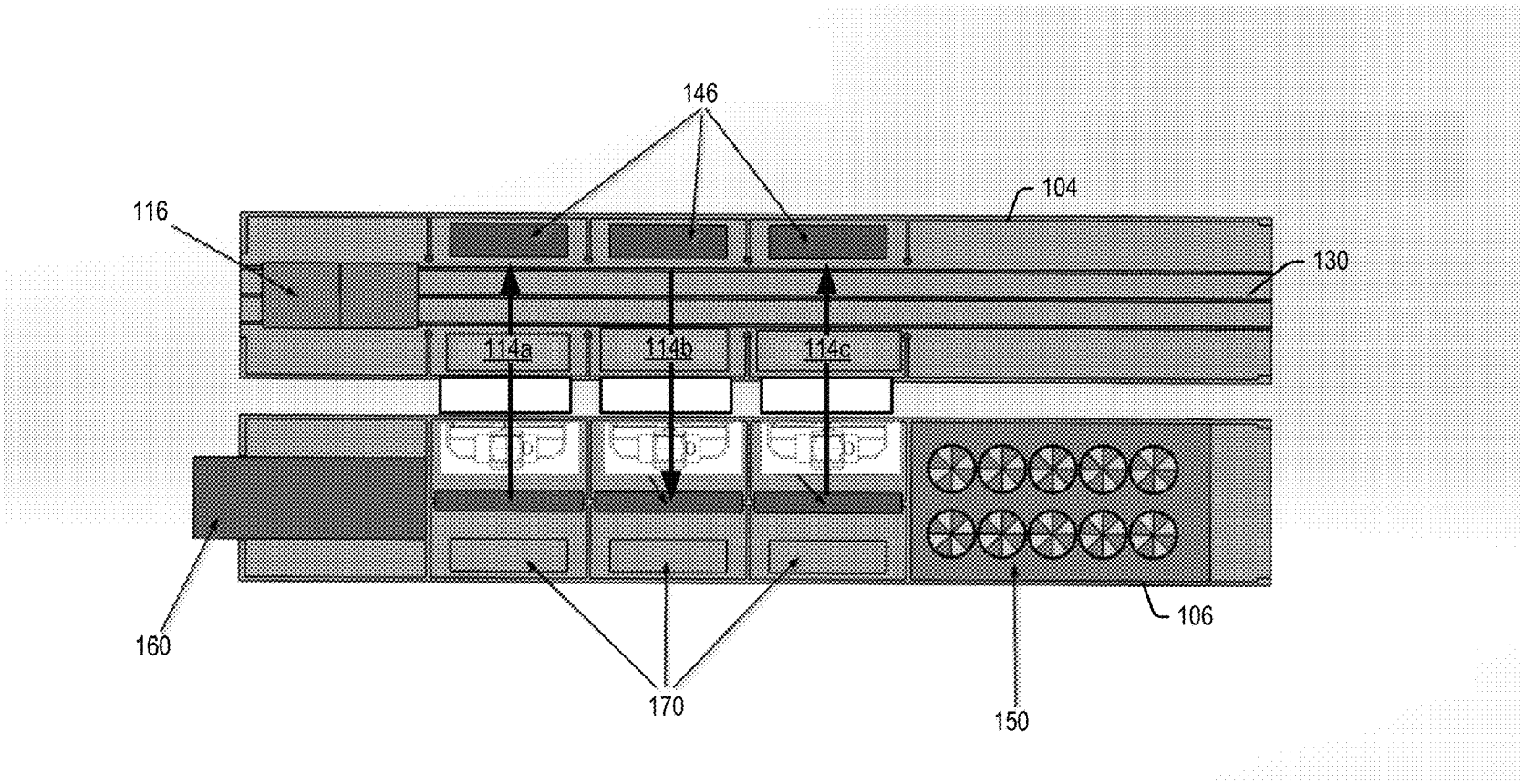
FIG. 7 is a top view of a portable cooling unit including dual trailers with their ceilings removed for clarity according to embodiments of the present disclosure.

The cooling chambers 114 may each include optical pallet sensors 132 (one of which is shown in FIG. 5) for sensing the presence and positions of the pallets of perishable items 116 within the cooling chamber along the conveyance direction. While sensor 132 is shown in a particular position in FIG. 5, the sensors 132 may be provided at different positions and oriented horizontally (to the side of the pallets) or vertically (over the top of the pallets) in embodiments of the present technology. The sensors 132 provide position feedback to the control system 200 to enable determination of when pallets of perishable items 116 are properly positioned within the respective cooling chambers 114. One or both of the staging areas 122 and 124 may also have optical pallet sensors 132 in further embodiments. An example of an optical pallet sensor for use in the present technology is the EQ-500 series photoelectric sensors from Sunx Ltd., having offices at 2431-1 Ushiyama-cho, Kasugai-shi, Aichi, 486-0901, Japan, though other sensors are contemplated.

The second staging area 124 may be cooled so that the perishable items 116 may be transferred from the third cooling chamber 114*c*, to the second staging area 124 and then to a refrigerated refer or holding area. Thus, the cooled perishable items 116 do not get exposed to ambient temperatures and the cold chain is maintained throughout the product transfer. The second staging area may be cooled in a variety of manners, including from exposure to the cooled third cooling chamber 114*c*. Additionally or alternatively, the rear end 104*b* of second staging area 124 may interface directly with the refrigerated refer or holding area, which may cool the second staging area 124. The conveyor system 130 may deliver the perishable items 116 to the second staging area 124. Thereafter, the perishable items may be transferred from the second staging area to the refrigerated refer or holding area, for example by pallet jacks operating within the second staging area.

The conveyor trailer 104 may further include fan openings 142 in the sidewall 120 within each of the cooling chambers 114 as shown in FIG. 5. Each cooling chamber 114 may further include a fan return opening 146 in a floor of each of the cooling chambers. The fan return openings 146 open to a plenum 148 provided beneath the floor of each of the cooling chambers 114. The plenums 148 in the conveyor trailer (and the plenums 168 in the refrigeration trailer described below) provide a return path for air moving from the refrigeration trailer 106 to the conveyor trailer 104, or vice a versa as described hereinafter. The plenums 148 and/or 168 may periodically be cleaned. Access to the plenums may be provided through the plenum 142 openings shown in FIG. 5. Access to the plenums may also be provided through plenum access openings 144 shown in FIGS. 1 and 2. Although shown uncovered in FIGS. 1 and 2, the plenum access openings 144 may be covered during operation of the fan units as described below.

As described hereinafter, cold air from the refrigeration trailer may be forced through the fan opening 142 into a given cooling chamber 114, through the perishable items 116, and then back to the refrigeration trailer through the fan return opening 146 and plenum 148. As is also described hereinafter, air may flow in the opposite direction in different cooling chambers so that cold air from the refrigeration trailer may alternatively travel through the plenum 148 and fan return opening 146, through the perishable items 116 and then back to the refrigeration trailer through the fan opening 142.

The refrigeration trailer 106 provides cold air to the respective cooling chambers 114 to cool the perishable items 116 as the pallets are moved through the conveyor trailer 104. In general, the refrigeration trailer 106 includes a refrigeration unit 150 (FIGS. 2, 3 and 6) for continuously cooling and circulating a working fluid. The refrigeration trailer 106 further includes enclosed compartments 154 comprised of compartments 154*a*, 154*b* and 154*c*. The number of compartments 154 may be more or less than three and is configured to match the number of cooling chambers 114 in the conveyor trailer 104. Each compartment 154 may include heat exchange coils 156 and fan units 158, shown for example in FIGS. 6-10. The refrigeration trailer further includes a generator 160 for powering the refrigeration unit 150 and fan units 158. Electrical connections between the trailers 104 and 106 may be established once the trailers are positioned, so that generator 160 may also power the motors in the conveyor trailer 104.

The refrigeration unit 150 may operate according to a wide variety of known refrigeration cycles and associated components. In one example, the refrigeration unit 150 may include a variety of components, including a compressor, a condenser, a refrigerant pump and an expansion throttle, for continuously cooling and recirculating a working fluid. The refrigeration unit 150 may be connected in-line with the coils 156 in each compartment 154. Cooled working fluid is pumped to the coils 156 in each compartment. Heat passes into the working fluid through the coils 106 and the working fluid then returns to the refrigeration unit 150 where it is again cooled to complete the thermodynamic cycle.

Each of the coils 156 may be connected by a common line to the refrigeration unit 150 so that each of the coils receive working fluid at the same temperature. It is contemplated that the coils 156 may be connected by different lines to the refrigeration unit 150, and that working fluid sent to coils 156 of different compartments 154 be further heated or cooled so that the coils in different compartments receive the working fluid at different temperatures. In embodiments, the working fluid may be Freon, or glycol. These working fluids have the advantage that they do not require operating and safety permits for its use or transport. Other known refrigerants may be used in alternative embodiments, including for example a salt-water brine solution.

As explained below, the conveyor trailer 104 includes first and second openings (142, 148) in each cooling chamber, and the refrigeration trailer 106 includes third and fourth openings (155, 168) corresponding in shape and position to the first and second openings. When the trailers are positioned adjacent each other, the first opening interfaces with the third opening and the second opening interfaces with the fourth opening to provide a closed loop air circulation path for circulating cold air through the perishable items.

The air in the compartments 154 is cooled by the cold working fluid passing through the coils 156, and the fan units 158 circulate the cooled air from each of the compartments 154 in the refrigeration trailer 106 to respective cooling chambers 114 in the conveyor trailer around the air circulation path. In particular, the fan units 158 are mounted adjacent fan openings 155 (one of which is numbered in FIG. 6) formed in a sidewall 157 of the refrigeration trailer 106. The fan openings 155 in the refrigeration trailer 106 align in number, shape and position to the fan openings 142 (FIG. 5) in the conveyor trailer 104 when the trailers 104, 106 are positioned next to each other.

In order to evenly cool perishable items 116, it has been found to be advantageous to circulate cold air first through one side, and then through a second, opposed side, of the containers holding perishable items 116. It has further been found to be advantageous to finish the cooling process by again circulating cold air through the first side of the containers.

Thus, in accordance with one mode of operation, pallets of perishable items 116 may be conveyed from the first staging area 122 to the first cooling chamber 114*a*. As indicated by the arrows in top view of FIG. 7 and the cross-sectional end view of FIG. 8, the fan unit 158 in compartment 154*a* may rotate in a direction to force air from the compartment 154*a* to the cooling chamber 114*a* and through perishable items 116 from a first side 116*a* and out a second side 116*b*. The air, warmed by the perishable items 116, then exits the cooling chamber 114*a* through the fan return opening 146 and plenum 148. The warmed air then returns to the refrigeration trailer 106 via plenum 168 and returns to the compartment 154*a* via fan return opening 170. The air is then cooled by coils 156 and the cycle repeats.

The pallets of perishable items 116 may then be conveyed from the first cooling chamber 114*a* to the second cooling chamber 114*b*. As indicated by the arrows in top view of FIG. 7 and the cross-sectional end view of FIG. 9, the fan unit 158 in compartment 154*b* may rotate in a direction opposite to that in compartment 154*a* to draw warm air from the cooling chamber 114*b* through the coils 156 where it is cooled. The cooled air then travels back to the cooling chamber 114*b* via fan return opening 170, plenum 168, plenum 148 and fan return opening 146. The cooled air then travels through the perishable items 116 from the second side 116*b* and out the first side 116*a*. The warmed air then returns to the compartment 154*b*, where it is cooled by coils 156 and the cycle repeats.

The pallets of perishable items 116 may then be conveyed from the second cooling chamber 114*b* to the third cooling chamber 114*c*. As indicated by the arrows in top view of FIG. 7 and the cross-sectional end view of FIG. 10, the fan unit 158 in compartment 154*c* may rotate in the same direction as in compartment 154*a* to force air to the cooling chamber 114*c* and through perishable items 116 from the first side 116*a* and out the second side 116*b*. The warmed air then returns to the compartment 154*c* via fan return opening 146, plenum 148, plenum 168 and fan return opening 170. The air is then cooled by coils 156 and the cycle repeats.

The time perishable items 116 spend in each cooling chamber 114*a*, 114*b* and 114*c*, and the operation of the fan unit 158, may be controlled by the control system 200 as explained hereinafter. The above-described mode of operation may vary in further embodiments. For example, the third cooling chamber 114*c* may be omitted. Additionally, the fan units 158 may be capable of rotation in two opposite directions. Thus, it is contemplated that a fan unit operate to force air through one side of perishable items 116 during a first period of time, and then the fan unit may be reversed to force air through the opposite side of perishable items 116 for a second period of time, all while perishable items 116 remain the same cooling chamber. Other modes of operation are contemplated.

The system according to the present technology employs a variety of seals in order to control the airflow between the refrigeration trailer 106 and conveyor trailer 104, and through the perishable items 116. For example, a inter-trailer airflow seal 172 may be positioned between trailers 104 and 106 to ensure airflow without leakage between the trailers 104 and 106, through compartments 154 and chambers 114, as well as through plenums 148 and 168.

As noted above with respect to FIG. 1, trailers 104 and 106 are positioned at a worksite 102 adjacent and generally parallel to each other. In embodiments the spacing between trailers 104 and 106 may be approximately 16 to 20 inches, though it may be greater or lesser than this range in further embodiments. In practice, it is difficult to precisely control this spacing when parking trailers 104 and 106 next to each other, and it is also difficult to precisely control the parallelism of trailers 104 and 106. Thus, inter-trailer airflow seal 172 needs to establish a firm seal around the airflow openings in trailers 104 and 106, while at the same time being flexible to accommodate different spacings and degrees of parallelism of trailers 104 and 106.

These objectives may be accomplished by inter-trailer seal 172. In embodiments, seal 172 may be an inflatable seal having a maximum thickness (when inflated) at least as great as the spacing between trailers 104 and 106. After the trailers 104 and 106 are positioned, a inter-trailer airflow seal 172 may be positioned around each of the fan openings 142, 155 on the conveyor and refrigeration trailers. The seal 172 may then be inflated to a pressure establishing a firm seal around the fan openings 142, 155 in trailers 104 and 106. How much a given seal needs to be inflated depends on the actual spacing between the trailers 104 and 106, as well as the parallelism of trailers 104 and 106. Given the flexible nature of the inflatable seal 172, the seal 172 is able to adapt to different spacings and degrees of parallelism. The airflow rate established by the fan units 158 may also affect how much seal 172 is inflated, with higher speeds of the fan units 158 resulting in a greater inflation and tighter seal around the fan openings 142, 155 in trailers 104 and 106.

Figure 11:
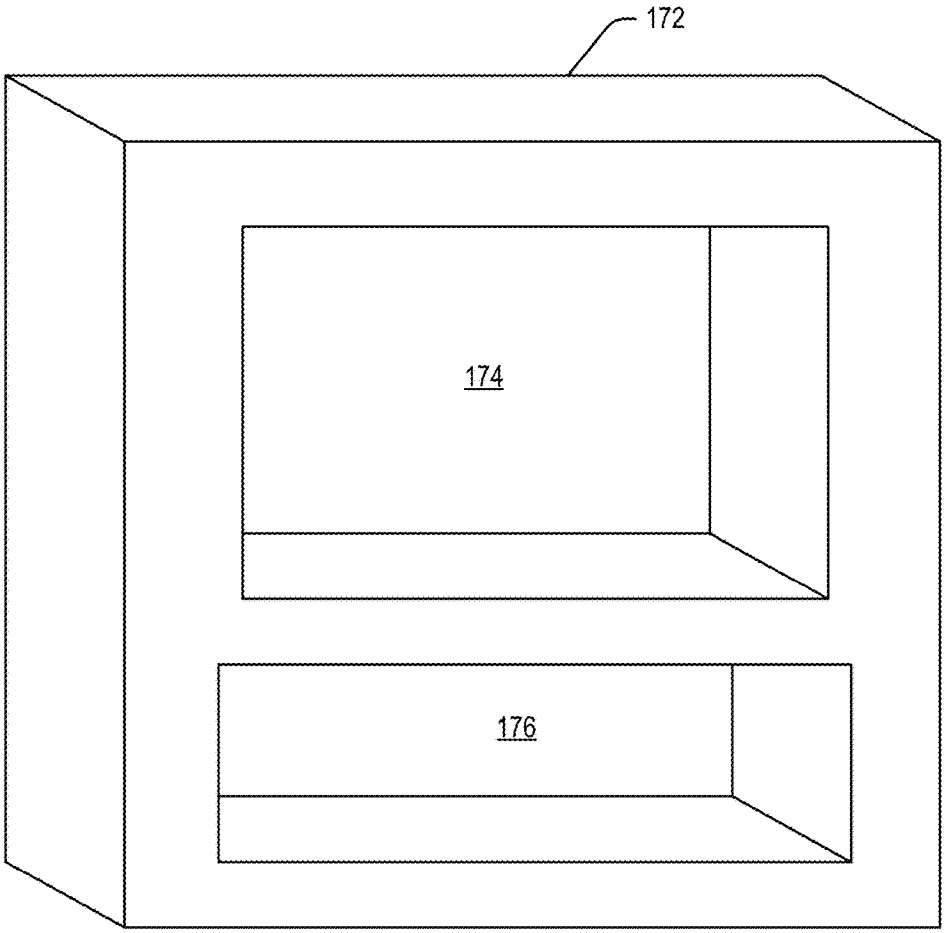
FIG. 11 is a perspective view of an inter-trailer seal to prevent air leakage between the trailers according to embodiments of the present disclosure.

Further details of inter-trailer airflow seal 172 will now be explained with reference to FIG. 11. As shown, the seal 172 is formed with two large holes 174 and 176. The hole 174 aligns with the fan opening 142 on trailer 104 and fan opening 155 on trailer 106 so that air may be communicated between fan openings 142 and 155 through the hole 174. Similarly, hole 176 aligns with the plenum 148 on trailer 104 and plenum 168 on trailer 106 so that air may be communicated between plenums 148 and 168 through the hole 176. There may be one inter-trailer seal 172 for each cooling chamber 114/compartment 154 pair.

In embodiments, the seal 172 may be 88 inches high by 91 inches wide by 20 inches deep when fully inflated. In embodiments, the fan openings 142, 155 and hole 174 may be a 52 inch square. In embodiments, the plenums 148, 168 and hole 176 may be 79 inches wide by 18 inches high. Each of these dimensions is a way of example only and each may vary in further embodiments. Each inter-trailer airflow seal 172 may be hung on the sidewall of either the conveyor trailer 104 or refrigerator trailer 106 by a cleat or pulley system so that it may be installed and removed as needed.

Figure 12:
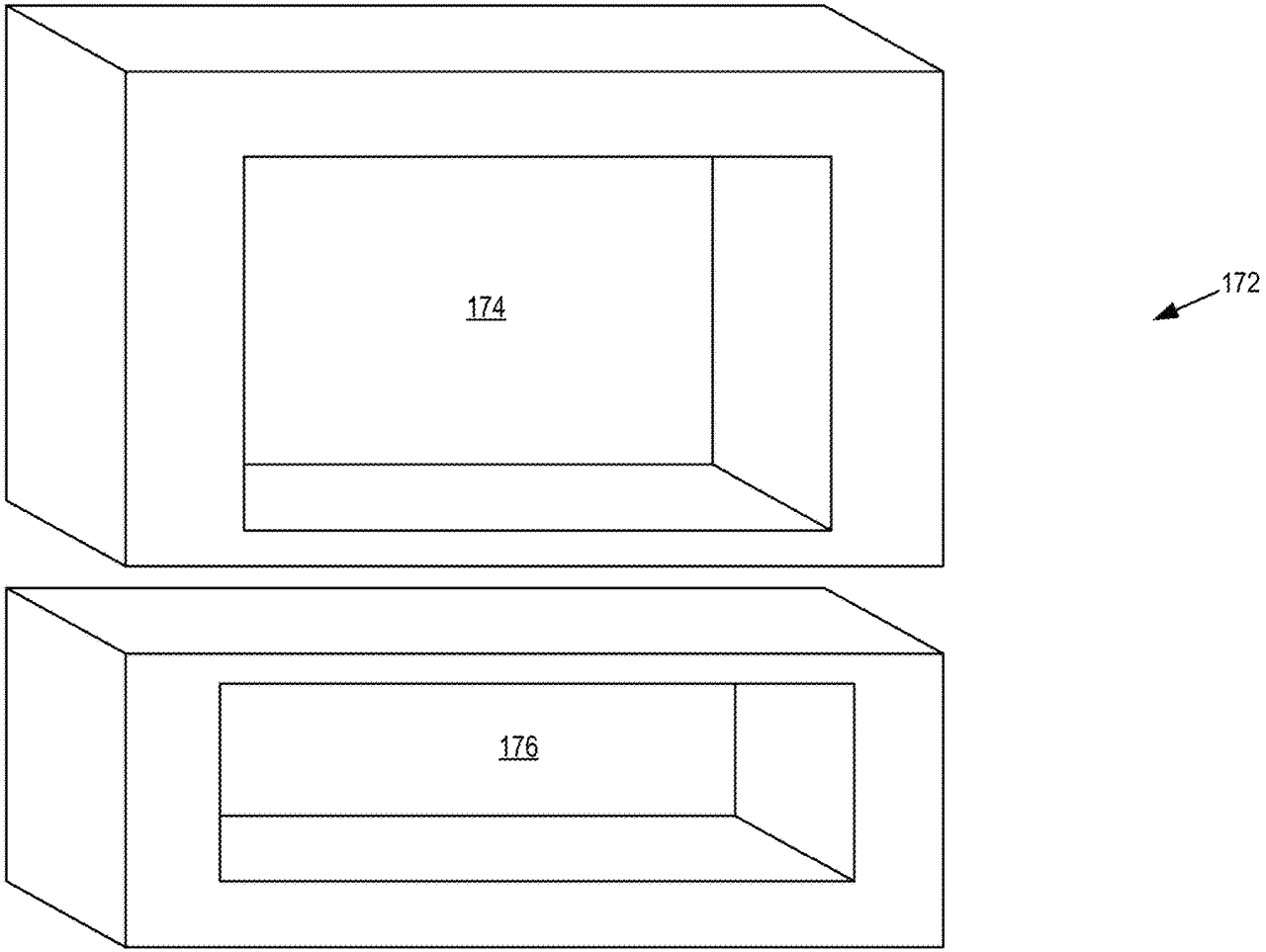
FIGS. 12-13B are views of inter-trailer seals to prevent air leakage between the trailers according to alternative embodiments of the present disclosure.

In a further embodiment of seal 172 shown in FIG. 12, a first portion of the seal including hole 174 may be separate or separable from a second portion of the seal including hole 176. This may make it easier to hang and otherwise work with the seal 172. Both portions may be hung on the sidewall(s) of the trailer(s) as described above. Alternatively, the first portion with hole 174 may be hung from the trailer sidewall, and the second portion with hole 176 may be hung from the first portion.

Figure 13A:
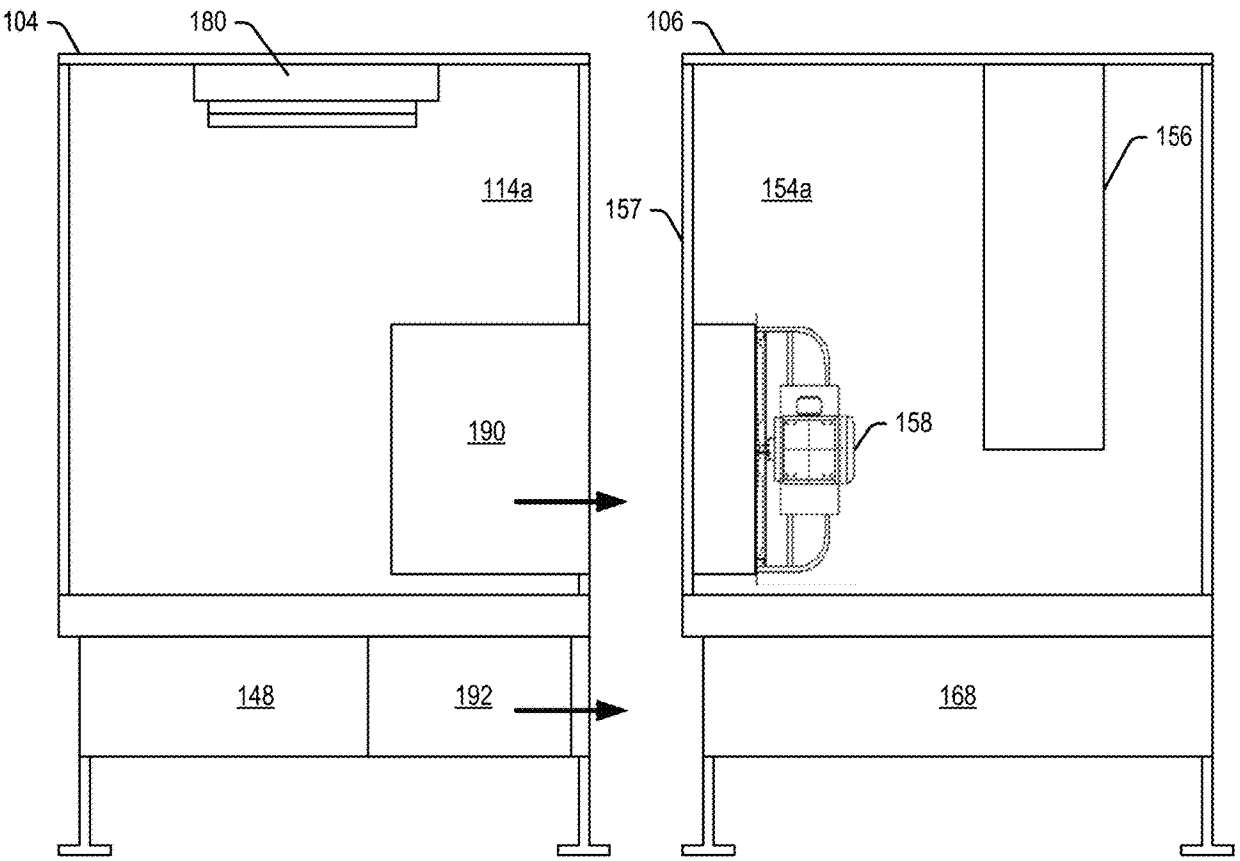
Figure 13B:
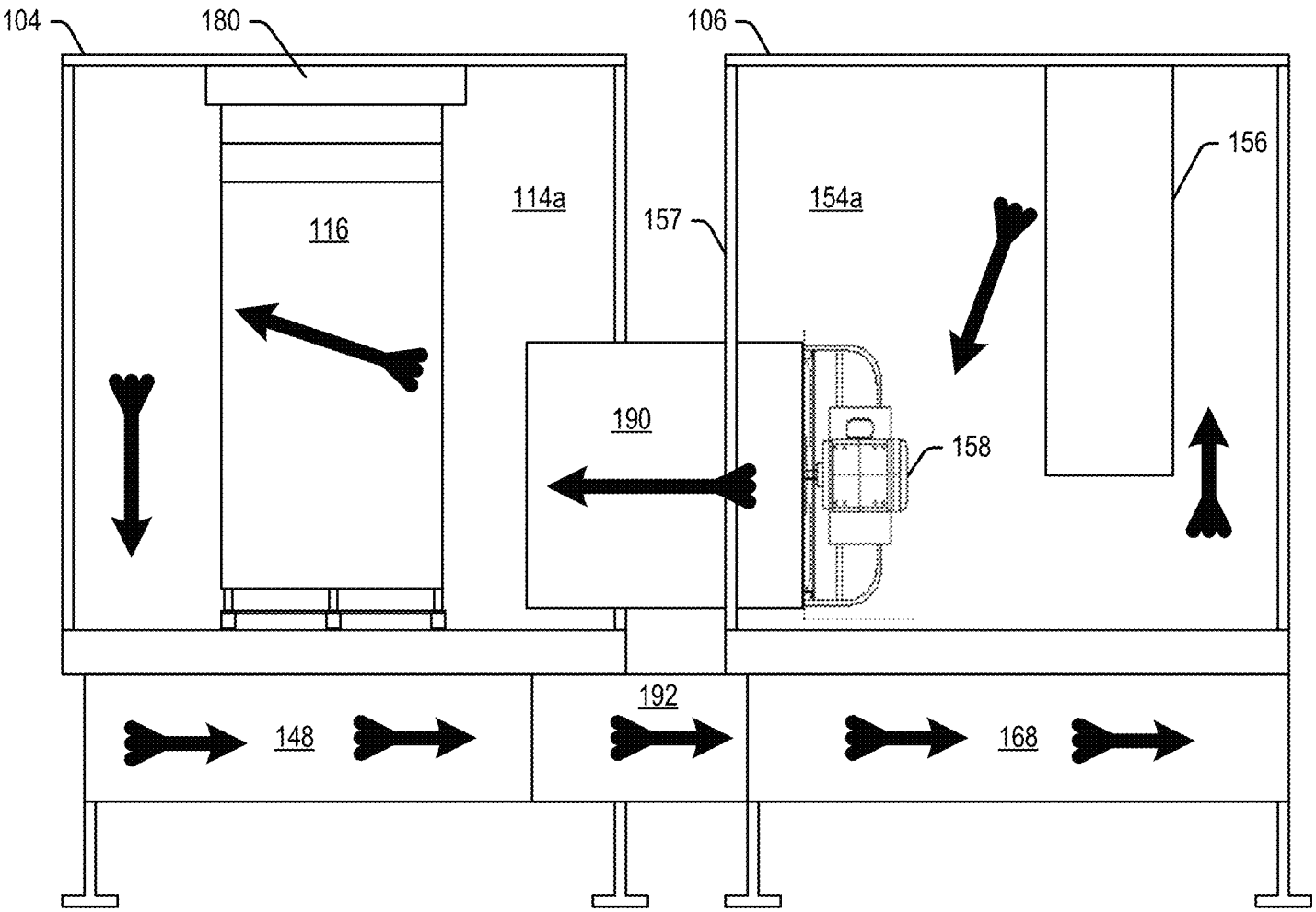

FIGS. 13A and 13B show a further embodiment of an infra-trailer seal. In this embodiment, the inter-trailer seal for each air flow path associated with each cooling chamber may include a pair of ducts 190, 192 which may extend from the trailer 104, across the gap between the trailer 104 and 106, and into contact with the trailer 106. As shown in FIG. 13A, the ducts 190, 192 may be refracted within the conveyor trailer 104 during transport of the trailer 104 and prior to establishing the air flow paths and seals. As shown in FIG. 13B, the duct 190 may extend across the gap between trailers 104 and 106 when the trailers are positioned next to each other to form a seal between fan openings 142 and 155 in the trailers 104 and 106, respectively. The duct 192 may extend across the gap between trailers 104 and 106 when the trailers are positioned next to each other to form a seal between plenums 148 and 168 in the trailers 104 and 106, respectively. Thereafter, the fan units 158 may be turned on to establish the air flow paths (in the first direction or second direction) as described above.

The ducts 190 and 192 may be formed of sheet metal, plastic or other substantially rigid materials, and may be formed into a rectangular duct, open at opposite ends. The cross-sectional shape of the duct 190 may be provided to fit snugly within the fan opening 142. The cross-sectional shape of the duct 192 may be provided to fit snugly within the plenum 148. Once the trailers 104 and 106 are positioned with respect to each other, the ducts may be manually extended across the gap into contact with the sidewall 157 of trailer 106, around the fan opening 155 and plenum 168. In further embodiments, the ducts 190 and/or 192 may include telescopic sections so as to be able to extend telescopically across the gap between trailers 104 and 106. There may be a set of ducts 190, 192 for each cooling chamber in the conveyor trailer 104.

The inter-trailer airflow seal 172 prevents air loss as air travels between the trailers 104, 106. A separate set of seals are provided within each of the cooling chambers 114 so that, once pallets of perishable items 116 are positioned in a cooling chamber, and the fan unit 158 begins airflow, air is forced through the perishable items 116 as opposed to bypassing around the perishable items 116. These inter-chamber seals comprise inflatable vertical inter-chamber seals 178 mounted along the vertical length of the inner edge of each of the dividers 118 defining the boundaries of the cooling chambers 114*a*, 114*b* and 114*c*. Some of the vertical inter-chamber seals 178 are numbered in FIGS. 2, 3 and 5. The inter-chamber seals 178 may have an accordion-type configuration so as to expand inward toward each other and the perishable items when the seals are inflated.

The length of the cooling chambers 114 in the x-direction is provided to the approximately equal to the length in the x-direction of a predetermined number of pallets of perishable items 116. When the vertical inter-chamber seals 178 are deflated, the conveyor system 130 may convey the perishable items along the conveyor path without contact with the seals 178. Once the perishable items 116 are fully positioned within a cooling chamber (such as for example the perishable items 116 shown in cooling chambers 114*b* and 114*c* in FIGS. 2 and 3), the seals 178 may be inflated so as to contact the front and rear vertical edges of the containers carrying the perishable items 116, thus forming a vertical seal along the containers carrying the perishable items 116. The control system 200 may sense when perishable items 116 are fully seated within a cooling chamber 114 based on feedback from the optical sensors 132 (FIG. 5).

Figure 8:
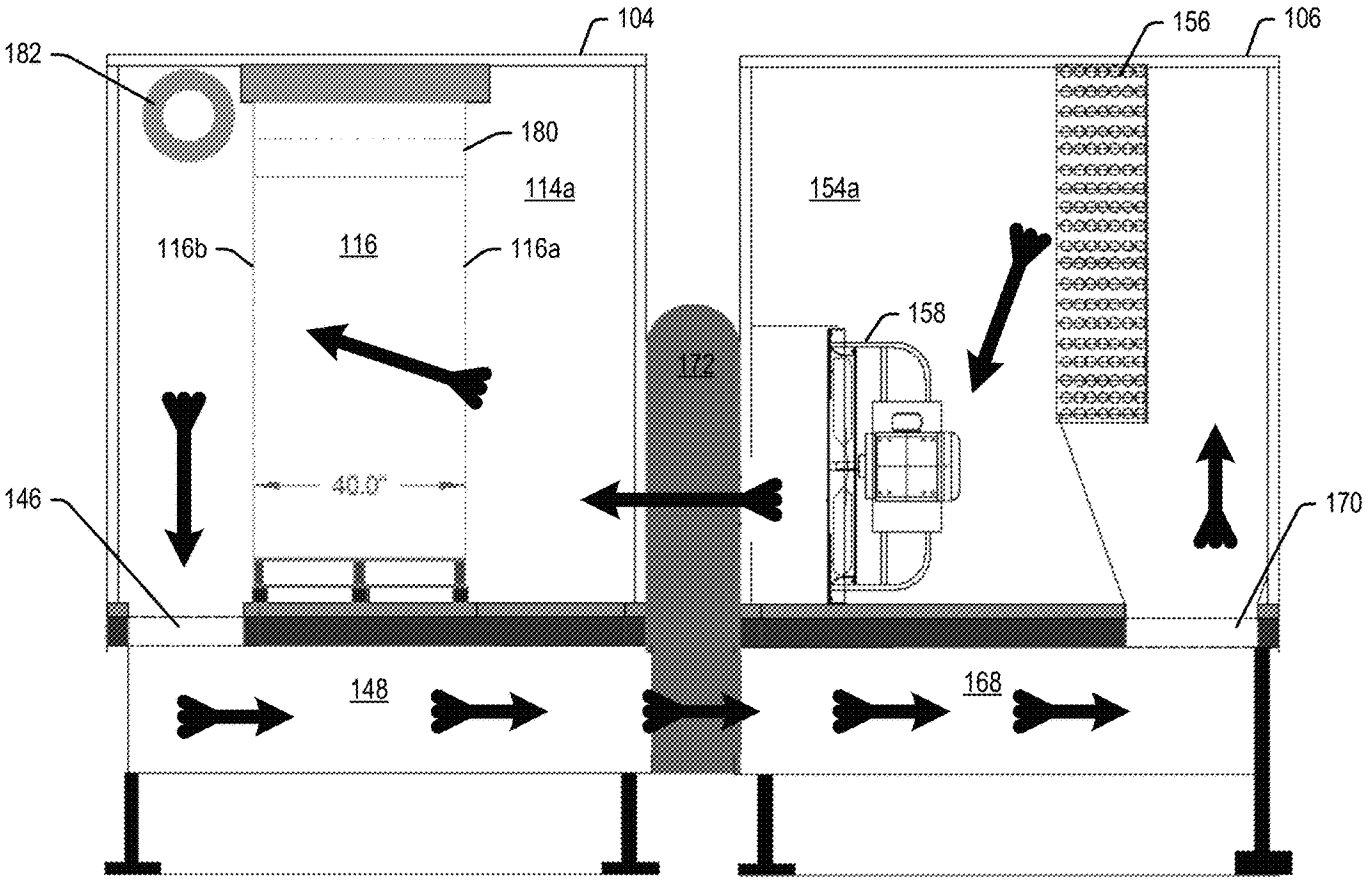
FIGS. 8-10 are cross-sectional end views of air flow through different zones of a portable cooling unit including dual trailers according to embodiments of the present disclosure.
Figure 9:
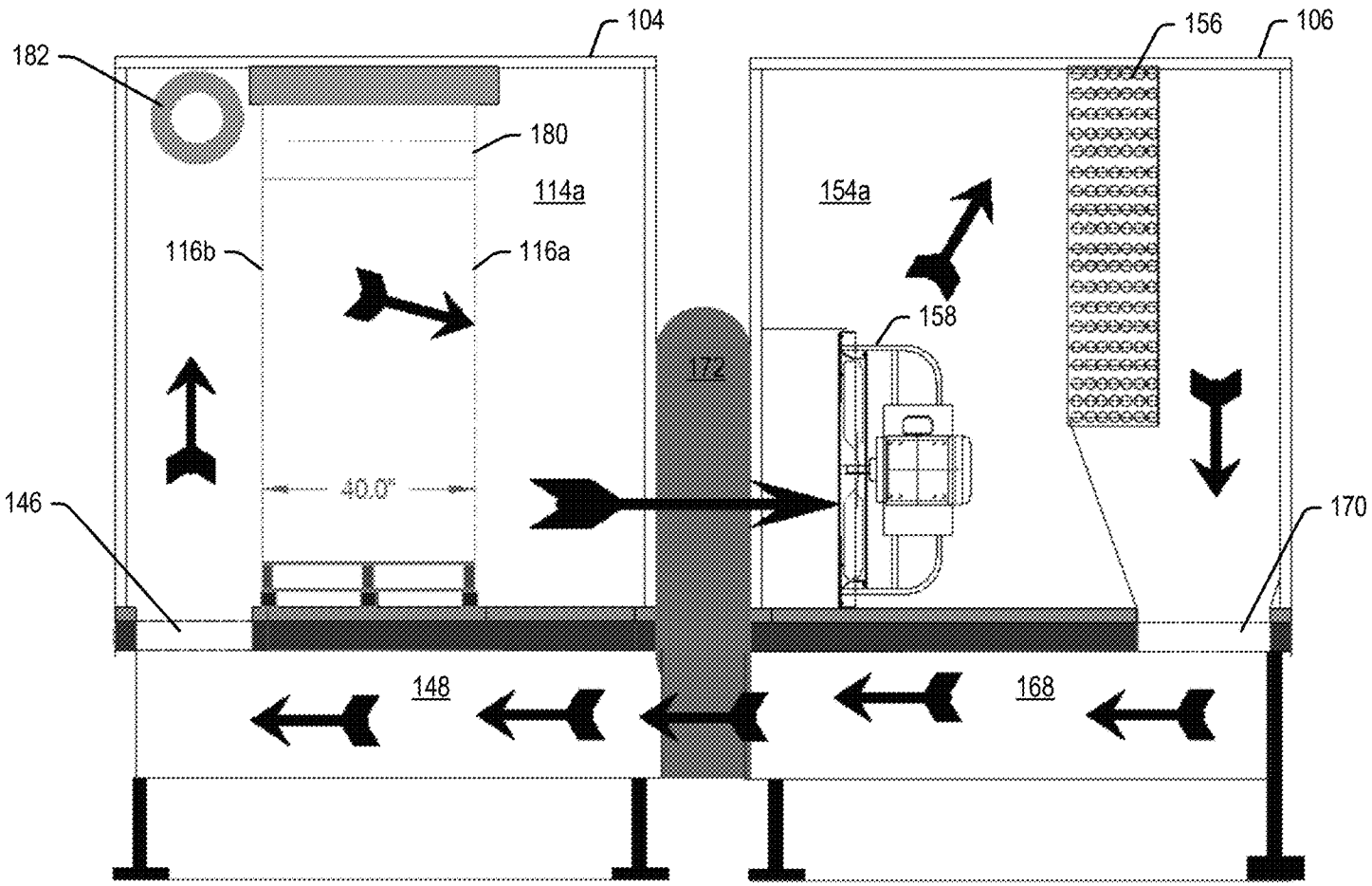
Figure 10:
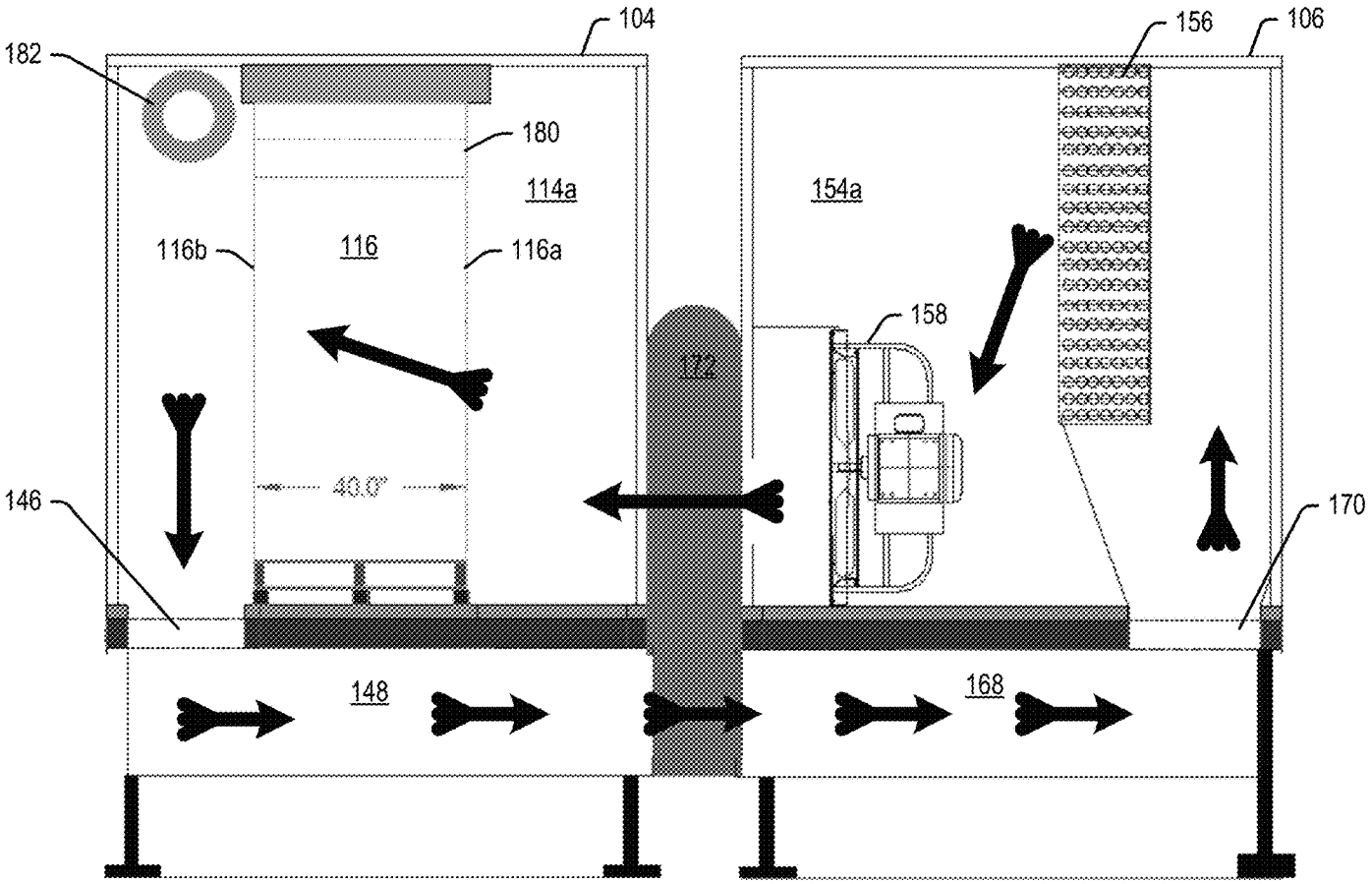

Each cooling chamber 114 may further include a horizontal inter-chamber seal 180 mounted above the perishable items 116. For example, as shown in FIGS. 8-10, a horizontal inter-chamber seal 180 may be mounted to a ceiling of the conveyor trailer 104 (or otherwise supported above the pallets of perishable items 116). The horizontal inter-chamber seals 180 may have an accordion-type configuration so that, when the seals 180 are deflated, they are retracted up toward the trailer ceiling, and the conveyor system 130 may convey the perishable items along the conveyor path without contact with the seals 180. Once the perishable items 116 are fully positioned within a cooling chamber, the seals 180 may be inflated so that they expand downward into contact with the upper surface of the containers carrying the perishable items 116 (as shown in FIGS. 8-10). In this way, the horizontal inter-chamber seals 180 form a horizontal seal along the upper surface of the containers carrying the perishable items 116.

It is noted that both the vertical seals 178 and horizontal seals 180 are capable of sealing containers for perishable items 116 of different sizes. Additionally, the horizontal seals 180 are independently mounted within each cooling chamber 114, so as to be able to seal against an upper surface of the perishable items, even if they have different heights in the different cooling chambers.

The vertical and horizontal inter-chamber seals 178, 180 may be inflated by a seal inflation motor 182 schematically shown in FIGS. 8-10. The motor may be bidirectional, so as to both inflate the seals 178, 180 into contact with the perishable items 116, and to deflate the seals 178, 180 retract the seals from the perishable items 116. As each of the cooling chambers 114 may operate independently of the others, each cooling chamber 114 may include its own seal inflation motor 182. Two or more cooling chambers 114 may share a single seal inflation motor 182 in further embodiments.

The operation of all motors and electrical systems may be controlled by control system 200 shown schematically mounted to the sidewall of conveyor trailer 104 in FIG. 1. It is understood that the controller system 200 may be mounted elsewhere on trailer 104 and/or trailer 106. Moreover, control system 200 need not be mounted on a trailer, but may connect to a junction box somewhere on trailer 104 and/or trailer 106 via a tethered cable. In further embodiments, the control system may communicate with and control the motors and electoral systems of the cooling unit 100 wirelessly. While a single control system 200 is shown for controlling components of both the conveyor trailer 104 and refrigeration trailer 106, is understood that the controller system 200 may be comprised of a first controller for controlling components of the conveyor trailer 104 and a second controller for controlling components of the refrigeration trailer 106.

Control system 200 may comprise a computing device including a microprocessor, random access memory and read only memory for executing one or more control algorithms controlling the operation of the cooling unit 100. Control system 200 may further comprise nonvolatile memory for storing control algorithms and data regarding the operation of cooling unit 100. Control system 200 may further include an input/output (I/O) interface including for example a display and a keypad for manual control and/or modification of the control algorithms controlling the operation of the cooling unit 100.

In one embodiment, the control system may be used to control the operation of the components in the refrigeration trailer 106. For example, the control system 200 may control the operation of the refrigeration unit 150, to set, increase or decrease the temperature of the working fluid supplied to the coils 156 in the respective compartments 154.

The control system 200 may further control and coordinate conveyance and cooling of the perishable items 116 through the conveyor trailer 104. For example, the control system may control the conveyor system 130 to convey pallets of perishable items 116 to each of the cooling chambers in a predetermined and coordinated manner. Moreover, upon receiving feedback from the optical sensors 132 in each cooling chamber 114 that the perishable items are in position, the control system 200 may inflate the inter-chamber seals 178, 180, and activate the fan units 158 to cool the perishable items. The control system 200 may also control the length of the cooling process in each of the cooling chamber 114. The control system 200 may also control the in-feed and offload of pallets of perishable items 116 within the staging areas 122, 124. For example, the control system can ensure that two pallets are properly positioned with respect to each other in the first staging area 122 before initiating conveyance to the first cooling chamber 114*a*.

As noted, each of the above-described parameters may be controlled automatically by control algorithms. Additionally, at least some or all of these parameters may be set or modified manually by an operator interacting with the control system 200 via the control system I/O interface. For example, an operator can override and change cycle times within one or more of the cooling chambers 114 on the fly in real time. An operator can also change the direction of airflow on-the-fly in real time through one or more cooling chambers.

In summary, embodiments of the present technology relate to a portable cooling unit for initiating a cold chain for perishable items, comprising: a first trailer configured to convey perishable items through a plurality of cooling chambers; and a second trailer configured to positioned side-by-side with the first trailer to provide cold air through the perishable items in each of the plurality of cooling chambers of the first trailer.

In a further example, the present technology relates to a portable cooling unit for initiating a cold chain for perishable items, comprising: a first trailer configured to convey perishable items through a plurality of cooling chambers, each cooling chamber including first and second openings in a sidewall of the first trailer; a second trailer configured with a plurality of compartments corresponding in number and position to the plurality of cooling chambers, the second trailer including third and fourth openings corresponding in shape and position to the first and second openings, such that the first opening interfaces with the third opening and the second opening interfaces with the fourth opening when the first and second trailers are positioned side-by-side with each other to provide a closed loop air circulation path for circulating cold air through the perishable items for each cooling chamber; and a plurality of inter-trailer seals configured to provide a seal around the first and third openings and around the second and fourth openings for the plurality of air circulation paths.

The foregoing detailed description of the invention has been presented for purposes of illustration and description. It is not intended to be exhaustive or to limit the invention to the precise form disclosed. Many modifications and variations are possible in light of the above teaching. The described embodiments were chosen in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

I claim:

1. A portable cooling unit for initiating a cold chain for perishable items, comprising:

a first trailer configured to convey perishable items through a plurality of cooling chambers; and a second trailer configured to be positioned side-by-side with the first trailer to provide cold air through the perishable items in each of the plurality of cooling chambers of the first trailer;

wherein the first trailer includes first and second openings in each cooling chamber, and the second trailer includes third and fourth openings, the first and third openings configured to interface with each other, and the second and fourth openings configured to interface with each other, to provide a closed loop air circulation path between the first and second trailers for circulating cold air through the perishable items for each cooling chamber.

2. The portable cooling unit recited in claim 1, wherein the first and second trailers operate as a self-sustained cooling unit, without any external connections to power or working fluid.

3. The portable cooling unit recited in claim 1, further comprising an inter-trailer seal providing a seal around the first and third openings and around the second and fourth openings for an air circulation path.

4. The portable cooling unit recited in claim 1, further comprising a refrigeration unit in the second trailer for cooling the air circulated around the closed loop air circulation paths.

5. The portable cooling unit recited in claim 1, further comprising a plurality of fan units in the second trailer, one fan unit for each cooling chamber, the fan units circulating the cold air around the air circulation paths.

6. The portable cooling unit recited in claim 5, wherein a first fan unit of the plurality of fan units circulates the cold air in a first direction around a first air circulation path of the air circulation paths, and a second fan unit of the plurality of fan units circulates the cold air in a second direction, opposite to the first direction, around a second air circulation path of the air circulation paths.

7. The portable cooling unit recited in claim 1, wherein the first and second trailers are positioned adjacent each other and cool perishable items at a field where the perishable items are harvested.

8. A portable cooling unit for initiating a cold chain for perishable items, comprising:

a first trailer configured to convey perishable items through a plurality of cooling chambers, each cooling chamber including first and second openings in a sidewall of the first trailer;

a second trailer configured with a plurality of compartments corresponding in number and position to the plurality of cooling chambers, the second trailer including third and fourth openings corresponding in shape and position to the first and second openings, such that the first opening interfaces with the third opening and the second opening interfaces with the fourth opening when the first and second trailers are positioned side-by-side with each other to provide a closed loop air circulation path for circulating cold air through the perishable items for each cooling chamber; and a plurality of inter-trailer seals configured to provide a seal around the first and third openings and around the second and fourth openings for the plurality of air circulation paths.

9. The portable cooling unit recited in claim 8, wherein the inter-trailer seals are inflatable to establish a seal around the first and third openings and around the second and fourth openings despite variable positions of the first trailer relative to the second trailer.

10. The portable cooling unit recited in claim 8, wherein the inter-trailer seals are extendable from the first trailer to the second trailer across a gap between the first and second trailers to establish a seal around the first and third openings and around the second and fourth openings despite variable positions of the first trailer relative to the second trailer.

11. The portable cooling unit recited in claim 8, further comprising a plurality of vertical inter-chamber seals for sealing vertical edges of the perishable items in the plurality of cooling chambers.

12. The portable cooling unit recited in claim 8, further comprising a plurality of horizontal inter-chamber seals for sealing horizontal surfaces of the perishable items in the plurality of cooling chambers.

13. The portable cooling unit recited in claim 8, wherein the first and second trailers operate as a self-sustained cooling unit, without any external connections to power or working fluid.

14. The portable cooling unit recited in claim 8, further comprising a refrigeration unit in the second trailer for cooling the air circulated around the closed loop air circulation paths.

15. The portable cooling unit recited in claim 8, further comprising a plurality of fan units in the second trailer, one fan unit for each cooling chamber, the fan units circulating the cold air around the air circulation paths.

16. The portable cooling unit recited in claim 14, wherein a first fan unit of the plurality of fan units circulates the cold air in a first direction around a first air circulation path of the air circulation paths, and a second fan unit of the plurality of fan units circulates the cold air in a second direction, opposite to the first direction, around a second air circulation path of the air circulation paths.

17. The portable cooling unit recited in claim 8, wherein the first and second trailers are positioned adjacent each other and cool perishable items at a field where the perishable items are harvested.

* * * * *